US009113695B2

(12) United States Patent
Gòmez et al.

(10) Patent No.: US 9,113,695 B2
(45) Date of Patent: Aug. 25, 2015

(54) ADJUSTABLE WIPER

(75) Inventors: Pilar González Gòmez, Ansbach (DE); Benjamin Kohlmann, Feuchtwangen (DE)

(73) Assignee: GEKA GMBH, Bechhofen (DE)

( * ) Notice: Subject to any disclaimer, the term of this patent is extended or adjusted under 35 U.S.C. 154(b) by 358 days.

(21) Appl. No.: 13/555,683

(22) Filed: Jul. 23, 2012

(65) Prior Publication Data

US 2013/0022385 A1 Jan. 24, 2013

(30) Foreign Application Priority Data

Jul. 22, 2011 (DE) ..... 20 2011 050 789 U

(51) Int. Cl.
*A46B 17/08* (2006.01)
*A45D 40/26* (2006.01)

(52) U.S. Cl.
CPC ..... *A45D 40/268* (2013.01); *A45D 40/267* (2013.01)

(58) Field of Classification Search
CPC ..... A45D 40/267; A45D 40/268
USPC ..... 401/122, 126–129; 132/218
See application file for complete search history.

(56) References Cited

U.S. PATENT DOCUMENTS

| | | | | |
|---|---|---|---|---|
| 3,892,248 | A | 7/1975 | Kingsford | |
| 4,261,376 | A * | 4/1981 | Kingsford | 132/218 |
| 5,363,870 | A * | 11/1994 | Doyon | 134/184 |
| 5,902,063 | A * | 5/1999 | Lhuisset et al. | 401/122 |
| 8,206,049 | B2 * | 6/2012 | Thiebaut | 401/122 |
| 8,523,473 | B2 * | 9/2013 | Kim | 401/126 |
| 8,662,777 | B2 * | 3/2014 | Thiebaut | 401/122 |
| 2005/0232681 | A1 | 10/2005 | Gueret | |

FOREIGN PATENT DOCUMENTS

| | | |
|---|---|---|
| CN | 1131903 A | 9/1996 |
| EP | 0116952 | 2/1984 |
| EP | 0202932 | 11/1986 |

OTHER PUBLICATIONS

Search Report issued by the German Patent Office for application No. 20 2011 050 789.0 on Apr. 25, 2012, 5 pages.

* cited by examiner

*Primary Examiner* — Jennifer C Chiang

(57) ABSTRACT

A cosmetics unit, in particular a mascara unit, that includes a storage container for storing the cosmetic to be applied, an applicator which in its stowed position preferably dips into the cosmetic, and a wiper device which wipes off a portion of the cosmetic picked up by the applicator during dipping. The wiper device consists of several wipers that produce a different wiping action and through which the applicator can be passed alternatively.

5 Claims, 1 Drawing Sheet

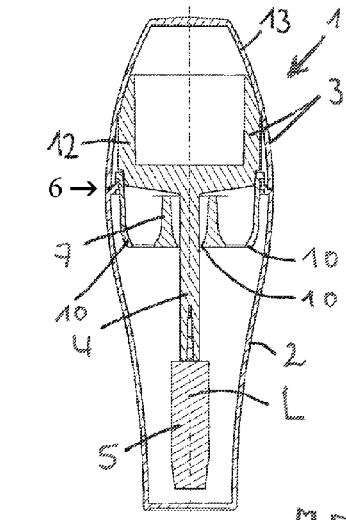
Fig. 1
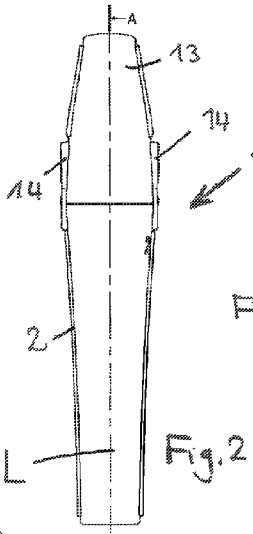
Fig. 2
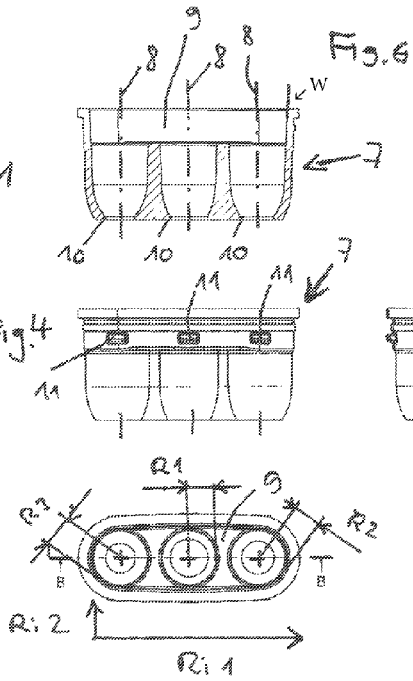
Fig. 6
Fig. 4
Fig. 5
Fig. 3
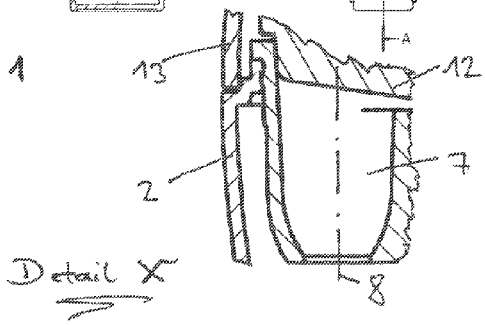
Detail X

ADJUSTABLE WIPER

FIELD OF THE INVENTION

The invention relates to a cosmetics unit, in particular in the form of a mascara unit.

BACKGROUND OF THE INVENTION

Cosmetics units of this type typically comprise a storage container containing the cosmetic. An applicator typically dips into this storage container and thus, also into the cosmetic. Most frequently this applicator is attached to the cap of the cosmetics unit by a shaft. As a rule the applicator dips into the supply of the cosmetic if and so long as it is in its storage position.

In order to apply cosmetic using the applicator, the applicator is drawn through a wiper which is typically located in the neck or the mouth of the cosmetics container. In the process, the applicator is relieved of a good portion of the cosmetic that it has stored between its bristles, fingers or other application organs due to having been dipped into the cosmetics supply. Such a wiping action is obligatory, because otherwise the applicator would, as a rule, remain charged with the cosmetic in too great an extent to be able to accomplish a neat application of cosmetics therewith.

How strong the wiping action is that the respective wiper exhibits is determined in the factory by the manufacturer of the cosmetics unit. Apart from the properties of the cosmetic mass (viscosity etc.), the decisive parameters are in this case particularly the mass storage capacity of the covering of the applicator and, of course, the design of the wiper.

The difficulty or challenge lies in designing the wiping action precisely in such a way that the wiping result of the wiper finds as broad an acceptance as possible amongst the users. Even if that should be accomplished, it is, however, in many cases unsatisfactory that the wiping action of a normal wiper cannot be readily adapted to the momentary need of the respective user, which may change from case to case.

It has therefore already been proposed to use adjustable wipers in which the user—for example by rotating the wiper into a certain position—is able to vary the diameter of the wiper lips that cause the actual wiping action. However, such adjustable wipers have drawbacks. On the one hand, they are, as a rule, of a multi-part construction and therefore expensive, on the other hand, they may become stuck over time, particularly if the wiper is not adjusted for a longer period of time. Furthermore, many of the adjustable wipers are continuously adjustable and therefore demand that, having purchased the product, one first becomes acquainted with the possibilities of the adjustable wiper in order to establish which of the many adjustment positions approximately ensures a wiping effect that corresponds to one's own need, and how the wiping action changes if the adjustable wiper is readjusted in one or the other direction as intended.

Therefore, it is an object of the invention to specify a cosmetics unit which, in a simple and inexpensive manner, enables wiping off the cosmetics applicator in different degrees as required.

SUMMARY OF THE INVENTION

According to the invention, a cosmetics unit, in particular a mascara unit, is thus provided, comprising a storage container for storing the cosmetic to be applied, an applicator which in its stowed position preferably dips into the cosmetic, and a wiper device which wipes off a portion of the cosmetic picked up by the applicator during dipping, wherein the wiper device consists of several wipers that produce a different wiping action and through which the applicator can be passed alternatively.

Being passed through alternatively means, in the broadest sense of the invention, that the applicator needs only to be passed through any one of the different wipers in order to pull it out from the cosmetics supply. In this case, the user can choose, when resealing the cosmetics container, through which of the wipers she returns the applicator into its stowed position.

In most cases (that is, preferably), the user has to pass the applicator through a predetermined one of the different wipers in order to return it into its stowed position. In that case, the applicator can only be passed through the other wipers in order to change its charge, but not in order to finally reseal the cosmetics unit.

The advantage of the further wiping option(s) in that case lies in that the user, after withdrawing the applicator through the first wiper that is to be used primarily, is able to decide, based on the visual impression of the charge of the applicator, to again pass the applicator through another wiper, which has a different, preferably stronger wiping action, in a next step prior to the actual application.

In particular, it is also possible that the user, after withdrawing the applicator, first applies a certain amount of the cosmetics mass and only later, when the mass application has been provisionally completed, pulls the applicator through another wiper, which due to its design relieves the applicator of the cosmetic still remaining thereon to such an extent that it can now be used as a comb, for example, for separating or shaping the eyelashes.

Preferably, the several wipers are each rigid wipers whose wiping actions cannot be modified and whose wiping actions are different from one another, preferably by the wiper lips of the individual wipers that produce the actual wiping action respectively having a different clear diameter. Such a design facilitates handling because the user is able to achieve different wiping results in a convenient manner without having to consider the function of the wiper(s) in detail.

Preferably, the several wipers are formed in a single integral wiper body, which is very advantageous with regard to production and costs (disposable articles). Alternatively, however, different wipers can be inserted in openings provided therefor.

In a particularly preferred exemplary embodiment, the integral wiper body circumferentially delimits an antechamber into which several wipers lead with their, relative to the wiper lip, distal ends. Such an inner chamber prevents splashing when the applicator is pulled out through the wiper. Furthermore, such an antechamber facilitates reliable sealing, also with respect to the wiper openings, which are not penetrated by an applicator stem in the closing position, therefore have a large free cross section, and as such thus tend to leak the cosmetic.

Preferably, the wiper body has an increased wall thickness in the area where it delimits the antechamber. This aids its sealing function, but as a rule also facilitates its reliable attachment in the mouth of the storage container.

Ideally, the wiper body, in the area in which it delimits the antechamber, forms a sealing seat against which a counter-sealing surface associated with the cap can be brought to rest in a sealing manner. Particularly preferred is the design of this sealing seat as a conical or wedge-shaped sealing seat with a sealing surface that is inclined by an angle W of 0.5° to 7° relative to the longitudinal axis L of the container.

Protection is sought also for a multiple wiper for insertion into a cosmetics unit as such, consisting of a preferably integral wiper body with several wipers that produce a different wiping action and that are suitable and intended for alternatively passing through an applicator.

Further advantages, optional embodiments and mechanisms of action of the invention become apparent from the exemplary embodiment for the invention described in more detail with reference to the Figures.

BRIEF DESCRIPTION OF THE DRAWINGS

FIG. 1 shows a sectional view of a cosmetics unit according to the invention.

FIG. 2 shows a lateral view of a cosmetics unit according to the invention.

FIG. 3 shows a top view of a multiple wiper according to the invention.

FIG. 4 shows a lateral view of a multiple wiper according to the invention, seen from its broad side.

FIG. 5 shows a lateral view of a multiple wiper according to the invention, seen from its narrow side.

FIG. 6 shows a section through a multiple wiper according to the invention, parallel to the broad side of the multiple wiper through its center.

DETAILED DESCRIPTION OF THE PREFERRED EMBODIMENTS

As can be seen rather well in FIGS. 1 and 2, the cosmetics unit 1 according to the invention consists of a storage container 2 and a cap 3. The cosmetics unit 1 in this case is a so-called sales unit, i.e. not a container for laboratory purposes, but a disposable container of appealing but inexpensive design, preferably of plastic with a wall thickness of between 0.3 and 1.5 mm.

As a rule the cap 3, once it is in its closed position, will not be rotatable relative to the storage container 2, but is stationarily latched onto or placed on the storage container 2 in order to seal it, and preferably fixated by additional retaining clips 14 or retaining means.

A stem 4 whose distal end, i.e. the end thereof facing away from the cap, carries an applicator 5 is attached to said cap. For this purpose, the stem, on the side thereof facing away from the applicator, expediently comprises a cup-like molded-on part 12, by which it is connected to, preferably latched onto or glued to, a shell 13 with which it forms the cap 3.

A wiper body 7 is inserted and latched into the opening 6 of the storage container.

For this purpose, both the edge of the opening 6 as well as the wiper body 7 are each provided at least with a corresponding latching organ and a corresponding latching recess.

In this case the wiper body 7 is configured as an integral plastic piece forming three individual wipers of a preferably conventional type which are disposed next to one another along a line B-B, i.e., whose longitudinal wiper axes 8 that form the respective center of the wiper all intersect the line B-B.

The three wipers differ only or substantially by the diameter of their wiping lip that is effective in wiping. However, the wiper opening can also have different geometries. As a rule, the wiper, which can be seen in FIG. 3 and is to be used primarily because it enables the applicator to be pushed into the cosmetics unit, will comprise a wiper lip whose clear diameter is the largest. The two other wipers, which are preferably disposed to the left and right of the wiper to be used primarily, which is in this case attached in the middle, each comprise a wiper lip whose clear diameter is slightly smaller. It has thus proved beneficial to provide the middle wiper with a radius R1 that determines its clear diameter, and the one of the adjacent wipers with a corresponding radius R2, which is at least 5%, better at least 7.5%, smaller than the radius R1, and the other one of the adjacent wipers with a corresponding radius R3, which is at least 10%, better at least 15%, smaller than the radius R1. However, it is also possible to use wipers with different geometries of the wiper opening.

For this purpose, the opening 6 of the storage container has a clear cross section which is larger than the clear cross section of the rest of the storage container adjacent to the opening 6. The reason for this will be explained in more detail below.

The storage container is not completely round but, at least in the region of its opening 6, has a cross section which in a first direction Ri1 is longer by the factor 1.5, better even by at least the factor 1.75, than in a second direction Ri2 perpendicular thereto. The side of the cap 3 cooperating with the opening 6 of the storage container is designed accordingly.

Towards its side facing away from the opening 6, the cross section of the storage container 2 preferably tapers in such a way that the storage container becomes slimmer in the direction of its side facing away from the opening 6, as was already mentioned above.

In this case, the storage container 2 preferably tapers in such a way that it is only through the wiper to be used primarily, which in this case is the middle one of the three, that the applicator can be pushed into the storage container 2 so deeply that the cap 3 can be brought into its closing position. Ideally the applicator can be pushed into the storage container only so far, through the two further wipers disposed to the left and the right of the middle wiper, that it passes the respective further wiper completely but then collides with the wall of the storage container, and is therefore prevented from further movement in a haptically perceptible manner before it dips into the stored cosmetic. Such an embodiment is expedient because it is thereby avoided that the applicator, which is moved through the further wiper in order to wipe it off to a greater extent, inadvertently dips back into the cosmetic mass, which would perhaps affect the desired stronger wiping action.

As can be seen rather well in FIG. 6, the wiper body 7 consists of an integral plastic piece. Sometimes, two, or in this case even three, wipers of a conventional construction are formed in this integral plastic piece. The wiper body is preferably manufactured in an injection-molding process, ideally from a single plastic material in a single process step. A preferred material for such a wiper body is, for example, the type of plastic sold under the brand name GRILFLEX®.

As can be seen, the integral wiper body forms an antechamber 9 delimited by its wall in the circumferential direction. Several wipers lead into this antechamber 9 with their distal ends, i.e. the ends facing away from the respective wiper lip 10. This antechamber collects the cosmetic mass which may possibly splash out when the applicator is withdrawn from the respective wiper, for example by individual bristles snapping into their unbiased positions once they have passed the narrow cross section of the respective wiper and are abruptly no longer subjected to a bending stress.

Moreover, this antechamber also serves for providing a sealing surface into which a corresponding counterpart of the cap or of the cup-like molded-on part 12 forming a component of the cap can be pressed, in order thus to be biased against the wall of the antechamber in such a manner that a tight connection is produced, at least between the wiper and the cap or its cup-like molded-on part 12. For this purpose, the inner surface of the wall of the antechamber 9 is expediently slightly inclined by the angle W, for example by 0.3°-5°, see FIG. 6. As soon as the counter-surface of the cap or of the cup-like molded-on part 12 of the cap is also equipped with a corresponding slight inclination, the final result is a conical seal which seals even if the cap is pressed against the storage container only lightly, and which additionally facilitates the accurate placement of the cap onto the storage container.

In view of this, it is readily understandable why the wall of the wiper body 7 delimiting the antechamber is configured to be thicker, and why it is ensured that the section of the wall can be connected to the opening of the storage container as firmly as possible. The area sealing the cosmetics container has to be configured to be as dimensionally stable as possible so that a reliable tightness is provided even if the cosmetics container is exposed, for example, to bending or locally concentrated stresses during transport in a handbag.

As can be seen, said wipers respectively consist of a preferably circular-conical passage which respectively forms a wiper lip 10 on its side facing into the container. The wiper lip 10 can integrally consist of the same material as the wiper body 7. Alternatively, modern two-component processes can be used in this case, i.e. of at least one of these wipers, the wiper lip, for example, can consist of a particularly soft or even rubber-elastic plastic that was molded on later.

Molding on such a wiper lip consisting of a particularly soft material may particularly make sense especially in the case of a multiple wiper as it is proposed herein—in order to render the wiping action of the wiper lip uniform and thus to counteract the tendency of the wiper lip to be more rigid in the wall area, which is particularly thick because it separates two adjacent wipers from each other, than in the area of the real outer wall of the respective wiper.

In the area of the antechamber 9, the wiper body has an annular peripheral area in which its wall thickness is increased. This area has an increased deformation resistance and therefore serves for securely retaining the wiper body 7 in the opening 6 of the storage container 2, see for example FIGS. 4-6.

The wiper body 7 also additionally carries several retaining projections 11 preferably in this reinforced area, in such a way as can best be seen in the FIGS. 4 and 5.

As can best be seen referring to the detail X of the FIG. 1, these retaining projections 11 latch behind a projection of the wall that delimits the opening 6 of the storage container.

The invention claimed is:

1. A cosmetics unit, comprising:

a storage container for storing a cosmetic to be applied;

an applicator which in its stowed position dips into the cosmetic; and a wiper device which wipes off a portion of the cosmetic picked up by the applicator during dipping, wherein the wiper device comprises a plurality of wipers formed in a single integral wiper body that circumferentially delimits an antechamber into which the plurality of wipers lead with their, relative to a wiper lip, distal end; and wherein each of the wipers produces a different wiping action and the applicator can be passed through the wipers alternatively.

2. The cosmetics unit according to claim 1, wherein the plurality of wipers are each rigid wipers whose wiping actions cannot be modified and whose wiping actions are different from one another by the wiper lips of the individual wipers that produce the actual wiping action respectively having a different diameter.

3. The cosmetics unit according to claim 1, wherein the wiper body has an increased wall thickness in an area where the wiper body delimits the antechamber.

4. The cosmetics unit according to claim 1, wherein the wiper body, in an area in which the wiper body delimits the antechamber, forms a sealing seat against which a counter-sealing surface associated with the cap can be brought to rest.

5. A cosmetics unit, comprising:

a storage container for storing a cosmetic to be applied;

a cap removably attached to the storage container, wherein when the cap is in a closed position the cap is not rotatable relative to the storage container; and a multiple wiper inserted into the storage container, the multiple wiper consisting essentially of an integral wiper body with a plurality of wipers formed in a single integral wiper body that circumferentially delimits an antechamber into which the plurality of wipers lead with their, relative to a wiper lip, distal end; and wherein each of the wipers produces a different wiping action and an applicator can be passed through the wipers alternatively.

* * * * *